US009793632B2

(12) United States Patent
Xue et al.

(10) Patent No.: US 9,793,632 B2
(45) Date of Patent: Oct. 17, 2017

(54) SPRING FINGER AND ELECTRICAL CONNECTOR

(71) Applicant: Tyco Electronics (Shanghai) Co. Ltd., Shanghai (CN)

(72) Inventors: Zhanglan Xue, Shanghai (CN); Wenke He, Shanghai (CN); Jiayong He, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/343,558

(22) Filed: Nov. 4, 2016

(65) Prior Publication Data

US 2017/0125931 A1 May 4, 2017

(30) Foreign Application Priority Data

Nov. 4, 2015 (CN) ..... 2015 2 0873312 U

(51) Int. Cl.

| | |
|---|---|
| ***H01R 12/00*** | (2006.01) |
| ***H01R 12/71*** | (2011.01) |
| ***H01R 4/02*** | (2006.01) |

(52) U.S. Cl.

CPC ..... *H01R 12/718* (2013.01); *H01R 4/02* (2013.01)

(58) Field of Classification Search

CPC .. H01R 23/722; H01R 23/6806; H01R 9/096; H01R 13/193; H01R 13/2442

USPC ..... 439/66, 71, 65, 342, 629, 636, 862

See application file for complete search history.

(56) References Cited

U.S. PATENT DOCUMENTS

| | | | | |
|---|---|---|---|---|
| 4,653,825 | A * | 3/1987 | Olsson | H01R 9/032 29/861 |
| 4,664,458 | A * | 5/1987 | Worth | H01R 12/52 174/138 D |
| 4,805,885 | A * | 2/1989 | Gingerich | H01H 15/06 267/165 |
| 2007/0155196 | A1 * | 7/2007 | Cheng | H01R 13/2435 439/66 |

* cited by examiner

*Primary Examiner* — Phuongchi T Nguyen
(74) *Attorney, Agent, or Firm* — Barley Snyder

(57) ABSTRACT

A spring finger of an electrical connector is disclosed. The spring finger includes a soldering section, a support section extending substantially perpendicularly from an end of the soldering section, a U-shaped first bend extending from an end of the support section opposite the soldering section and forming a first opening facing the soldering section, and a U-shaped contact structure obliquely suspended from an end of the first bend and spaced apart from the support section. The contact structure contacts a mating conductive terminal of a mating connector in a lateral direction parallel to the soldering section.

17 Claims, 4 Drawing Sheets

SPRING FINGER AND ELECTRICAL CONNECTOR

CROSS-REFERENCE TO RELATED APPLICATION

This application claims the benefit of the filing date under 35 U.S.C. §119(a)-(d) of Chinese Patent Application No. 201520873312.3, filed on Nov. 4, 2015.

FIELD OF THE INVENTION

The present invention relates to an electrical connector, and more particularly, to a spring finger of an electrical connector.

BACKGROUND

Known conductive terminals of electrical connectors are formed as spring fingers. The spring finger contacts a mating terminal of a mating connector to form an electrical connection between various electronic devices. In the prior art, a spring finger for connecting two printed circuit boards ("PCBs") has an electrical contact disposed thereon and the mating terminal is pressed on the electrical contact. Elastic deformation of the spring finger is restricted by a distance between the two connected PCBs, and the contact quality and stability between the spring finger and the mating terminal is dependent upon an assembling tolerance of the PCBs.

In the prior art, the mating connector is subject to an upward force due to the spring finger. It is therefore necessary to add a holding structure to provide a press force or a lock force to hold the spring finger and the mating connector together; the contact quality and stability will be adversely affected without an external lock force, thus resulting in an unreliable electrical connection. Moreover, a current transmission path along each spring finger only has one current channel from the contact along a cantilever to a soldering section of the terminal. Thus, a current transmission capacity is relatively small.

SUMMARY

An object of the invention, among others, is to provide a spring finger forming a reliable electrical connection with an improved current transmission capacity. The disclosed spring finger includes a soldering section, a support section extending substantially perpendicularly from an end of the soldering section, a U-shaped first bend extending from an end of the support section opposite the soldering section and forming a first opening facing the soldering section, and a U-shaped contact structure obliquely suspended from an end of the first bend and spaced apart from the support section. The contact structure contacts a mating conductive terminal of a mating connector in a lateral direction parallel to the soldering section.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
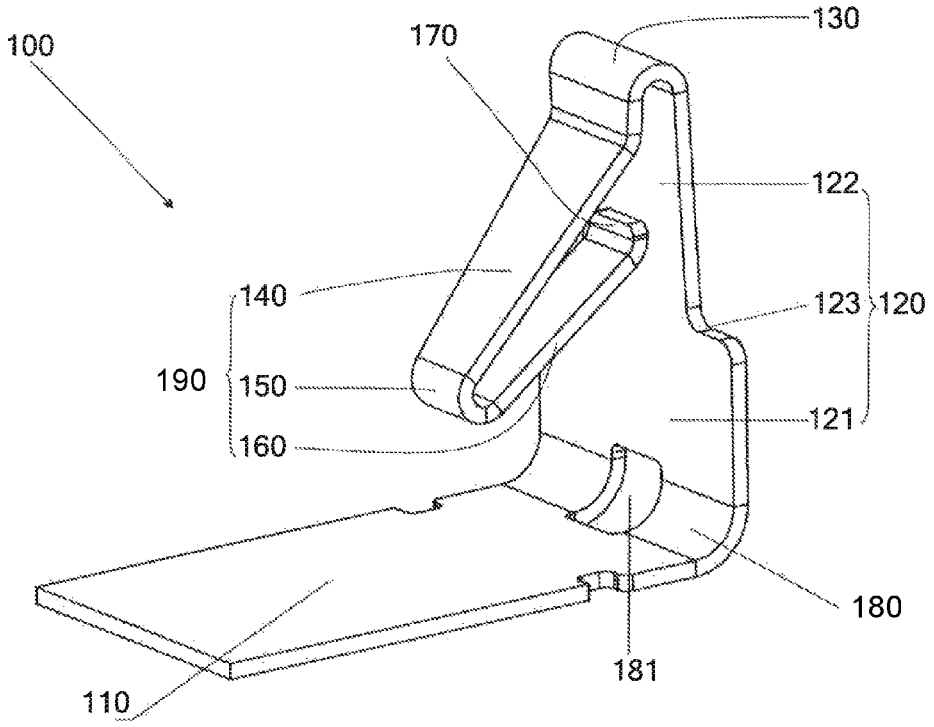
FIG. 1 is a perspective view of a spring finger according to the invention.

Embodiments of the present invention will be described hereinafter in detail, and examples thereof are illustrated in the attached drawings, in which like reference numerals refer to like elements. The specific embodiments described with reference to the attached drawings are only exemplary, so as to fully convey the scope of the invention to those skilled in the art, and should not be construed as limiting the present invention.

A spring finger 100 according to the invention is shown in FIGS. 1-4. As shown in FIG. 1, the spring finger 100 has a soldering section 110, a support section 120, a first bend 130, and a contact structure 190. The major components of the invention will now be described in greater detail.

Figure 2:
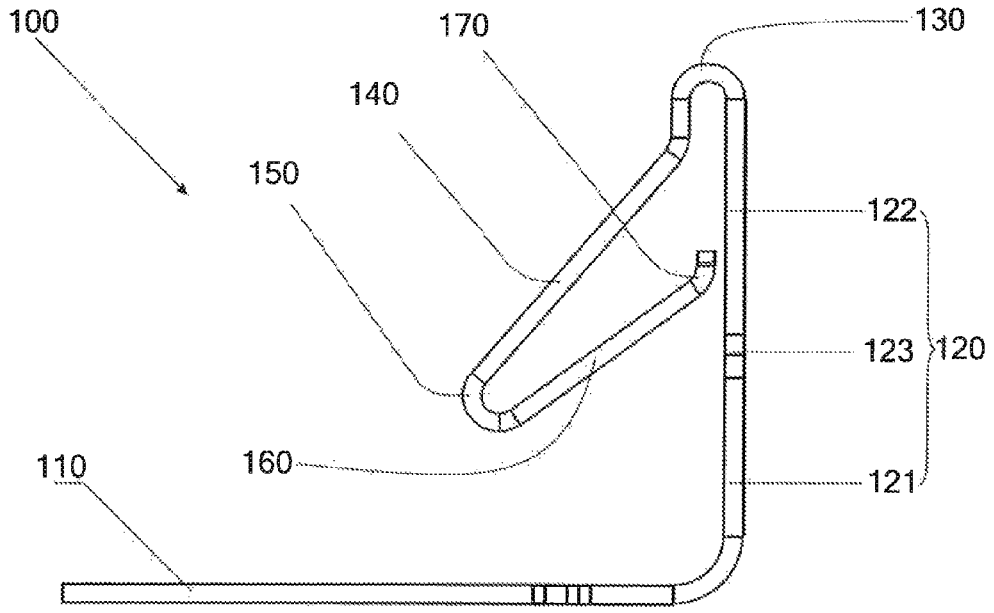
FIG. 2 is a side view of the spring finger of FIG. 1.

As shown in FIGS. 1 and 2, the soldering section 110, the support section 120, the first bend 130, and the contact structure 190 may be sequentially connected together or may be integrally formed from a conductive material. For example, the soldering section 110, the support section 120, the first bend 130, and the contact structure 190 may be integrally formed by punching a conductive sheet and bending the conductive sheet into the spring finger 100.

Figure 3:
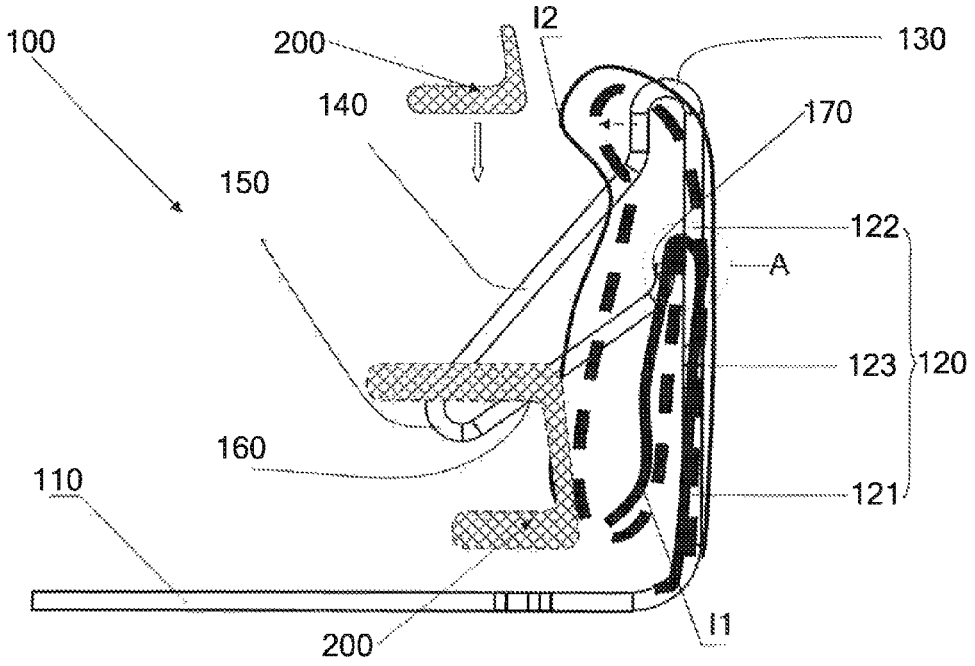
FIG. 3 is a side view of the spring finger of FIG. 1 in contact with a mating conductive terminal.

The soldering section 110, as shown in FIGS. 1-3, may have a substantially rectangular, planar shape. The support section 120 extends substantially perpendicularly from one end of the soldering section 110; the support section 120 and the soldering section 110 form an L-shaped structure. An angle formed between the soldering section 110 and the support section 120 is slightly smaller than or equal to 90 degrees. The support section 120 is connected to the soldering section 110 by a transition portion 180. As shown in FIG. 1, the transition portion 180 may be formed with a recess 181 to facilitate a punching process of the product.

As shown in FIGS. 1 and 2, the support section 120 is planar and has a variable section profile, such as a T-shape. In the embodiment shown in FIGS. 1 and 2, the support section 120 may include a first support portion 121 extending substantially perpendicularly from the soldering section 110 and a second support portion 122 extending from the first support portion 121. A width of the second support portion 122 is less than that of the first support portion 121, so that a support step 123 is formed between the first support portion 121 and the second support portion 122, forming the T-shaped profile.

The first bend 130 extends from an end of the support section 120 opposite the soldering section 110, at an end of the second support portion 122, and has an opening downwardly facing the soldering section 110. That is, the first bend 130 extends upwardly from the support section 120 and extends downwardly after bending toward the soldering section 110 so as to form a general U-shape having an opening facing the soldering section 110.

The contact structure 190, as shown in FIGS. 1 and 2, has a general U-shaped structure which suspends or extends obliquely from an end of the first bend 130 opposite the support section 120. The contact structure 190 is spaced apart from the support section 120 and an opening of the U-shaped contact structure 190 faces the support section 120 obliquely upwards.

The contact structure 190, as shown in FIGS. 1 and 2, includes a first arm 140, a second arm 160 and a generally U-shaped second bend 150 located between the first arm 140 and the second arm 160. The first arm 140 extends obliquely downwards towards the soldering section 110 from the end of the first bend 130 opposite the support section 120. The second bend 150 is bended from the first arm 140 toward the soldering section 110 and then toward the support section 120. The second arm 160 extends obliquely upwards and toward the support section 120 from an end of the second bend 150 opposite the first arm 140. The first arm 140 is connected with the U-shaped first bend 130 or extends integrally from the U-shaped first bend 130 and is bended obliquely to form the general U-shaped form of the contact structure 190, so that the contact structure 190 is formed as an oblique cantilever relative to the first bend 130. As shown in FIGS. 1 and 2, the second arm 160 has a free end 170 positioned higher than the support step 123.

At least one of the first arm 140 and the second arm 160 is planar and has a width gradually varied along its length. For example, as shown in FIG. 1, the width of the first arm 140 is gradually increased from the bottom up, while the width of the second arm 160 is gradually increased from the bottom up. Therefore, the elasticity of the whole spring finger 100 is improved.

The spring finger 100 is adapted to be used in an electrical connector such as a plate-to-plate connector, to connect various electronic devices such as circuit boards (for example, a PCB) with each other. The soldering section 110 is connected or soldered to a conductive trace provided on the circuit board, which for example is planar and is fixed onto the circuit board horizontally or in parallel thereto.

As shown in FIG. 3, the contact structure 190 is elastically deformed when electrically contacting a mating conductive terminal 200 of a mating connector. When the spring finger 100 is pressed by the mating conductive terminal 200, the mating conductive terminal 200 presses the oblique contact structure 190 from top to bottom, so that the free end 170 of the contact structure 190 is pressed against an inner side of the support portion 120 in a dashed line region A of FIG. 3. A portion of at least one of the first arm 140 and the second bend 150 contact the mating conductive terminal 200 in a lateral direction parallel to the soldering section 110 and the second arm 160 is pressed against the second support portion 122. The first support portion 121 of the T-shaped support section 120 is wider than the second support portion 122 so as to provide a lateral direction support force to the spring finger 100, thus restricting a deformation of the spring finger 100 toward an outside of the second portion 120 and reducing a space for the deformation of the spring finger 100 when contacting with the mating terminal 200.

When the contact structure 190 is deformed by the mating conductive terminal 200, two parallel current paths I1 and I2 shown in FIG. 3 are formed extending from a contact point between the spring finger 100 and the mating conductive terminal 200 to the soldering section 110 electrically connected with the conductive trace on the circuit board. The current path I1 extends along a part of the second bend 150, the second arm 160, the free end 170 and the first support portion 121. The current path I2 extends along part of the second bend 150, the first arm 140, the first bend 130, and the first and second support portions 121 and 122. The current path I1 is relatively shorter, thereby reducing a resistance. Meanwhile, the two parallel current paths I1 and I2 enhance a current transmission capacity of the spring finger 100, thereby improving the reliability of the spring finger 100. The free end 170 of the second arm 160 has an arced contact portion adapted to contact with the second support portion 122 and move smoothly along the second support portion 122 when the contact structure 190 is laterally pressed.

The contact structure 190, as shown in FIG. 3, has an arced surface contacting the mating conductive terminal 200. When the contact structure 190 is pressed by the mating conductive terminal, due to the arced surface, the contact structure 190 imparts only a force extending in the lateral direction parallel to the soldering section 110 on the mating conductive terminal 200; an upward counterforce is avoided, eliminating a requirement for additional upper and lower holding structures. Further, the spring finger 100 has a good elasticity in a horizontal direction parallel to the soldering section 110 so that the spring finger 100 and the mating conductive terminal have larger process and assembling tolerances while maintaining good contact reliability.

Figure 4:
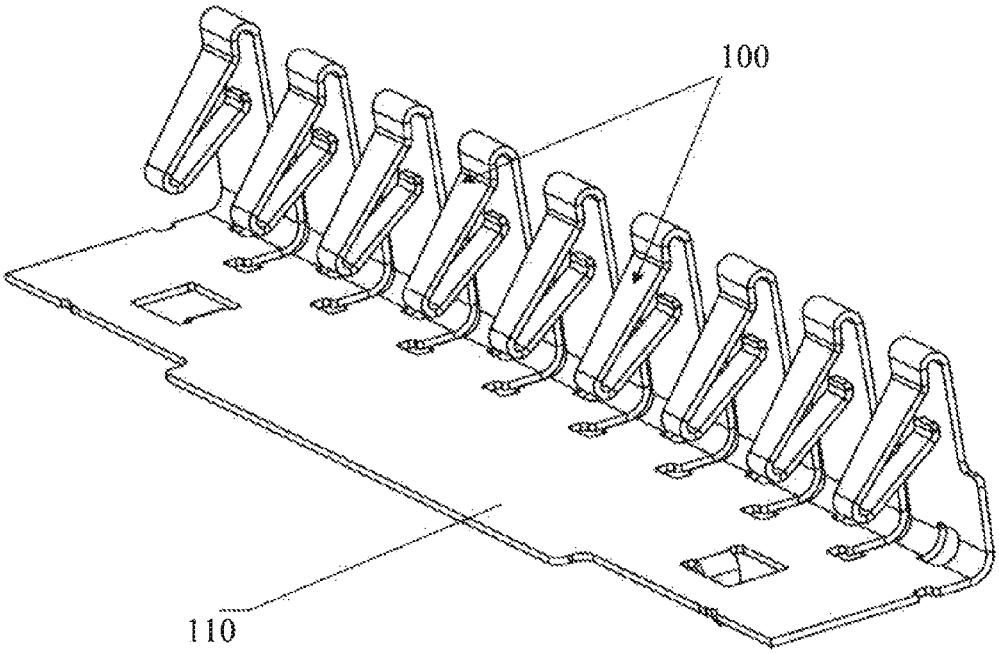
FIG. 4 is a perspective view of a plurality of spring fingers according to the invention.

In an embodiment of the invention shown in FIG. 4, a plurality of spring fingers 100 may be integrated together and have a common soldering section 110 for example, to form a set of spring fingers 100 in an electrical connector for electrically connecting a plurality of electronic devices.

What is claimed is:

1. A spring finger, comprising:

a soldering section;

a support section extending substantially perpendicularly from an end of the soldering section;

a U-shaped first bend extending from an end of the support section opposite the soldering section and forming a first opening facing the soldering section; and a U-shaped contact structure obliquely suspended from an end of the first bend and spaced apart from the support section, the contact structure contacting a mating conductive terminal of a mating connector in a lateral direction parallel to the soldering section.

2. The spring finger of claim 1, wherein the soldering section, the support section, the first bend, and the contact structure are integrally formed from a conductive material.

3. The spring finger of claim 1, wherein the contact structure forms a second opening facing the support section.

4. The spring finger of claim 3, wherein the soldering section is connected to a conductive trace of a circuit board.

5. The spring finger of claim 4, wherein the support section is planar.

6. The spring finger of claim 5, wherein the support section has a first support portion extending substantially perpendicularly from the soldering section and a second support portion extending from the first support portion.

7. The spring finger of claim 6, wherein a width of the second support portion is less than a width of the first support portion, forming a support step between the first support portion and the second support portion.

8. The spring finger of claim 7, wherein the support section has a T-shaped profile.

9. The spring finger of claim 7, wherein the contact structure has a first arm, a second arm, and a U-shaped second bend between the first arm and the second arm.

10. The spring finger of claim 9, wherein a portion of at least one of the first arm and the second bend contacts the mating conductive terminal in the lateral direction.

11. The spring finger of claim 9, wherein at least one of the first arm and the second arm is planar and has a width gradually varied along its length.

12. The spring finger of claim 9, wherein the first arm extends from an end of the first bend obliquely toward the soldering section.

13. The spring finger of claim 12, wherein the second arm extends from an end of the second bend opposite the first arm obliquely toward the support section.

14. The spring finger of claim 13, wherein the second arm has a free end positioned higher than the support step.

15. The spring finger of claim 14, wherein the free end is pressed against the second support portion when the contact structure contacts the mating conductive terminal.

16. The spring finger of claim 15, wherein the free end has an arced contact portion contacting the second support portion and moving along the second support portion.

17. An electrical connector, comprising:

a spring finger including a soldering section, a support section extending substantially perpendicularly from an end of the soldering section, a U-shaped first bend extending from an end of the support section opposite the soldering section and forming a first opening facing the soldering section, and a U-shaped contact structure obliquely suspended from an end of the first bend and spaced apart from the support section, the contact structure contacting a mating conductive terminal of a mating connector in a lateral direction parallel to the soldering section.

* * * * *